US008453361B2

(12) United States Patent
Garcia

(10) Patent No.: US 8,453,361 B2
(45) Date of Patent: Jun. 4, 2013

(54) QUILT FABRICATION AND DISPLAY DEVICE

(76) Inventor: Roberto Garcia, Vallejo, CA (US)

( * ) Notice: Subject to any disclaimer, the term of this patent is extended or adjusted under 35 U.S.C. 154(b) by 187 days.

(21) Appl. No.: 13/182,415

(22) Filed: Jul. 13, 2011

(65) Prior Publication Data

US 2013/0014411 A1 Jan. 17, 2013

(51) Int. Cl.

| | |
|---|---|
| ***D06C 3/08*** | (2006.01) |
| ***G09F 17/00*** | (2006.01) |
| ***D05B 11/00*** | (2006.01) |
| *E06B 9/00* | (2006.01) |

(52) U.S. Cl.

USPC ..... 38/102.1; 38/102.91; 160/372; 40/603; 112/117

(58) Field of Classification Search

USPC ..... 160/102.1–102.91, 379, 378, 381, 160/398; 40/603; 112/117

See application file for complete search history.

(56) References Cited

U.S. PATENT DOCUMENTS

| | | | | |
|---|---|---|---|---|
| 726,703 | A * | 4/1903 | Koepp | 38/102.5 |
| 2,403,661 | A * | 7/1946 | Hurley | 160/328 |
| 2,803,086 | A * | 8/1957 | Ross | 38/102.1 |
| 4,210,191 | A * | 7/1980 | Li | 160/354 |
| 4,833,805 | A * | 5/1989 | Roberson | 40/603 |
| 5,020,254 | A * | 6/1991 | Sheppard | 40/603 |
| 5,056,247 | A * | 10/1991 | Loomie | 38/102.1 |
| 5,127,177 | A * | 7/1992 | Tanner | 40/603 |
| 5,301,447 | A * | 4/1994 | Lotter et al. | 40/603 |
| 7,974,004 | B2 * | 7/2011 | Maruyama | 359/443 |

* cited by examiner

*Primary Examiner* — Ismael Izaguirre

(74) *Attorney, Agent, or Firm* — Bay Area Technology Law Group PC

(57) ABSTRACT

A quilt fabrication and display device and kit of parts for producing the display device. The device includes upper and lower stretcher rails separated from one another by use of a pair of rail support members, the upper stretcher rails and lower stretcher rails being substantially parallel to one another and the rail support members being substantially parallel to one another and substantially orthogonal to the upper and lower stretcher rails. The upper and lower stretcher rails and the rail support members are of two subparts and the kit includes fasteners for selectively connecting the subparts for assembly and disassembly of the device. A set of four butterfly wing extenders are provided each extender selectively attachable to the upper stretcher rails and lower stretcher rails such that when assembled, two of the butterfly wing extenders extend above the upper stretcher rails and two of the butterfly wing extenders extend below the lower stretcher rails. Further included within the kit is a substrate cable joining each of the butterfly wing extenders providing a cable perimeter having sections between the butterfly wing extenders parallel to the upper and lower stretcher rails and rail support members.

17 Claims, 5 Drawing Sheets

QUILT FABRICATION AND DISPLAY DEVICE

TECHNICAL FIELD

The present invention involves a quilt fabrication and display device capable of rapid assembly and disassembly as needed and which, upon disassembly, can compactly fit within a relatively small container for unobtrusive storage.

BACKGROUND OF THE INVENTION

Quilt making has remained popular for quite some time. Those involved in this craft can create quilting of surprisingly intricate and creative designs and patterns which can actually be hung as art work rather than used as bedding.

Because of the intricate nature of quilting patterns, there is a need to systematically engage in pattern layout requiring design walls in which pieces of, for example, flannel or felt is supported by a surface, the felt or flannel backing used to hold the quilt fabric pieces or blocks from sliding out of alignment during the design layout process. In this way, the quilter can place blocks in various positions as the final quilt pattern is established.

Amateur quilters can often times create design walls by simply rolling backing materials onto a table or counter top. More sophisticated quilters will either tack backing materials onto a wall, door or the like which not only can interfere with the use of these surfaces for domestic purposes but once the design wall is removed, the quilt fabric pieces can be dislodged and the effort taken to create the appropriate aesthetic quilt pattern can be lost.

Recognizing the need for a design wall that is easy to use, store and transport, U.S. Pat. No. 7,757,416 suggested a mounting sheet on its front side and backing sheet on its reverse side which are secured together peripherally. The mounting sheet is in the form of a heavy nap felt or flannel material while the backing sheet is preferably a soft flat nap fabric. A stiff rod is sown into a pocket extending laterally of the body at its bottom. The body includes a plurality of spaced mounting holes across its top. The holes facilitate removably mounting the body on hooks or nails extending from the wall or frame. However, because the invention of the '416 patent requires the use of hooks or nails, such a solution for an improved quilting design wall is less than ideal.

U.S. Pat. No. 6,862,823 provides an alternative design wall solution by proposing a piece of fabric coated on both sides with a dry tack adhesive. This facilitates selective attachment of the fabric to a wall on one side and allows for quilting to adhere to the fabric on its reverse side. However, using a dry tack adhesive which is humidity sensitive can compromise the utility of this invention. Also, such dry tack design walls tend to attract hair, dust, lint and other particles which are difficult to remove.

Quilters have also often employed quilting frames that are a close analogue of embroidery hoops to position and hold their work. These frames, like embroidery hoops, are generally constructed in some round or oblong shape and can be made to accommodate larger dimensions of a typical quilt. Quilting frames can also be constructed as to be free standing to support the large size and weight of typical quilts. However, most quilts, being rectangular in shape and of diverse sizes have been found difficult to support by a traditional frame. Further, quilters often times set up quilting frames or walls offsite and typical quilting frames are difficult to transport because of their bulk and size.

Their have been many other structures proposed to support fabric sheets for the purpose of making quilts. For example, reference is made to U.S. Pat. Nos. 875,261, 895,744 and 2,242,386, each teaching a stretcher for supporting sheets of material for the purpose of drying the same following washing or other treatments in which the sheets are contacted by water.

U.S. Pat. No. 4,736,535 describes a vertical embroidery frame utilizing retaining bars which may be adjusted and which also include casters for mobility along its surface.

U.S. Pat. Nos. 940,070, 2,000,397 and 4,665,638 describe quilting frames which hold a backing material in a horizontal position in order to allow the sewing of a quilt thereupon. These devices also include means for stretching the backing material to present a smooth and uninterrupted surface.

U.S. Pat. Nos. 2,177,720, 2,318,877, 4,658,521 and 6,209,240 describe quilting frame stands which hold a quilt backing sheet which is provided with components that are disassembled and reassembled to allow portability and versatility.

Finally, U.S. Pat. Nos. 991,476 and 5,711,098 describe quilting frame structures that hold quilts in a horizontal position and that include legs that are collapsible and extendable.

Notwithstanding the above-referenced body of prior art, it has been recognized that there has been no successful attempt to create a quilting frame which not only provides the versatility of accepting backing fabrics of diverse sizes but also is eminently collapsible for easy transporting and storage.

These and further objects will be more readily apparent when considering the following disclosure and appended claims.

SUMMARY OF THE INVENTION

A quilt fabrication and display device and kit of parts for producing the display device. The device includes upper and lower stretcher rails separated from one another by use of a pair of rail support members, the upper stretcher rails and lower stretcher rails being substantially parallel to one another and the rail support members being substantially parallel to one another and substantially orthogonal to the upper and lower stretcher rails. The upper and lower stretcher rails and the rail support members are of two subparts and the kit includes fasteners for selectively connecting the subparts for assembly and disassembly of the device. A set of four butterfly wing extenders are provided each extender selectively attachable to the upper stretcher rails and lower stretcher rails such that when assembled, two of the butterfly wing extenders extend above the upper stretcher rails and two of the butterfly wing extenders extend below the lower stretcher rails. Further included within the kit is a substrate cable joining each of the butterfly wing extenders providing a cable perimeter having sections between the butterfly wing extenders parallel to the upper and lower stretcher rails and rail support members. The kit can include a foldable foam board as a support for a suitable fabric wall surface.

DETAILED DESCRIPTION OF THE INVENTION

Figure 1:
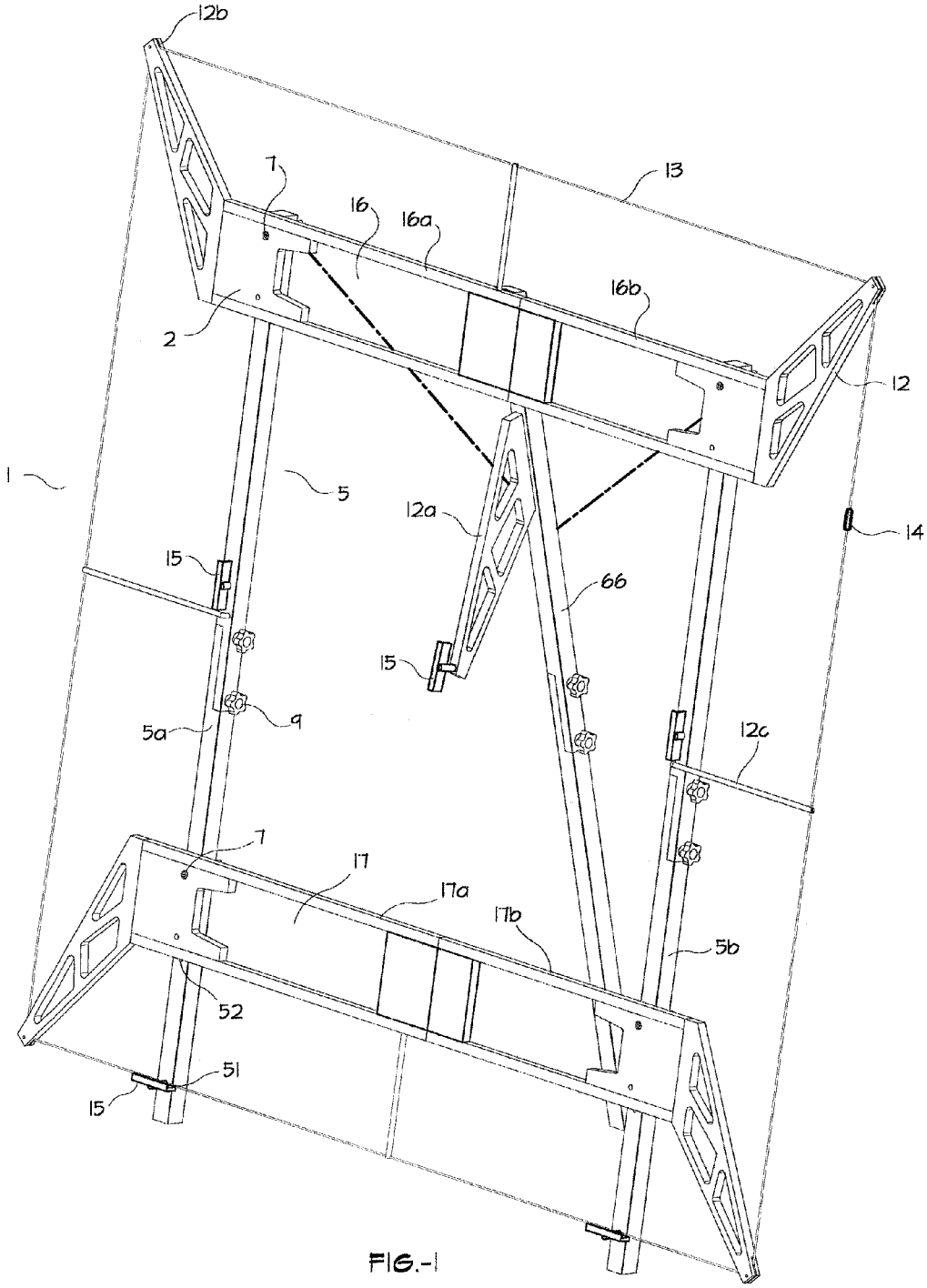
FIG. 1 is a front perspective view of the present invention depicting its various parts constituting the invention as a whole.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Turning first to FIG. 1, quilt fabrication and display device 1 is depicted. The device includes upper and lower stretcher rails 16 and 17, respectively which are separated from one another by use of a pair of rail support members 5*a* and 5*b* attached to stretcher ends 2 by thru bolts 7.

It is contemplated that the present invention be fabricated from a kit of parts enabling it to break down into a small rather compact package for easy transport and storage. In keeping with this notion, it is noted that stretcher rails 16 and 17 are selectively detachable into subparts 16*a* and 16*b* and 17*a* and 17*b* at the interface between midconnect braces 3. Similarly, rail support members 5 are composed of subparts 5*a* and 5*b* connected through the use of appropriate fasteners shown, by way of example, as thumb screws and knobs 9.

It is noted that when constructed, upper stretcher rails 16 and lower stretcher rails 17 are configured to be substantially parallel to one another and that rail support members 5 are likewise substantially parallel to one another and thus substantially orthogonal to said upper and lower stretcher rails 16 and 17. Thus, a square or rectangular configuration is established as the fundamental support constituting the present quilt fabrication and display device.

Figure 3B:
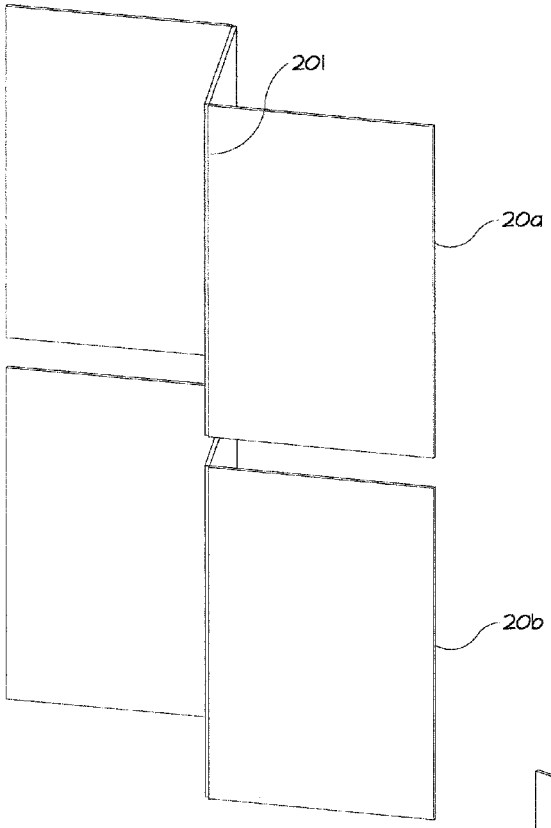
FIGS. 3A-3D are perspective views of foam board and connectors used to erect it, useful in employing the invention of FIGS. 1 and 2 in the art of quilt making and displaying.
Figure 3D:
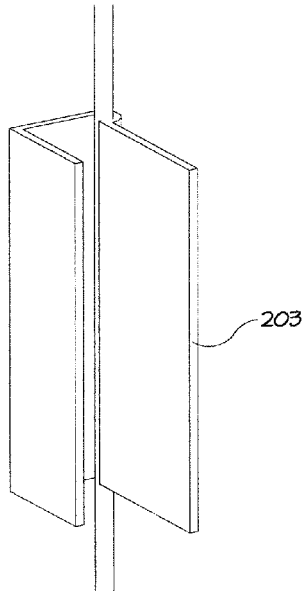
Figure 3C:
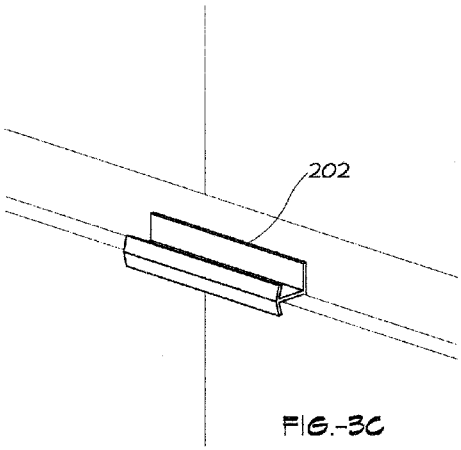
Figure 3A:
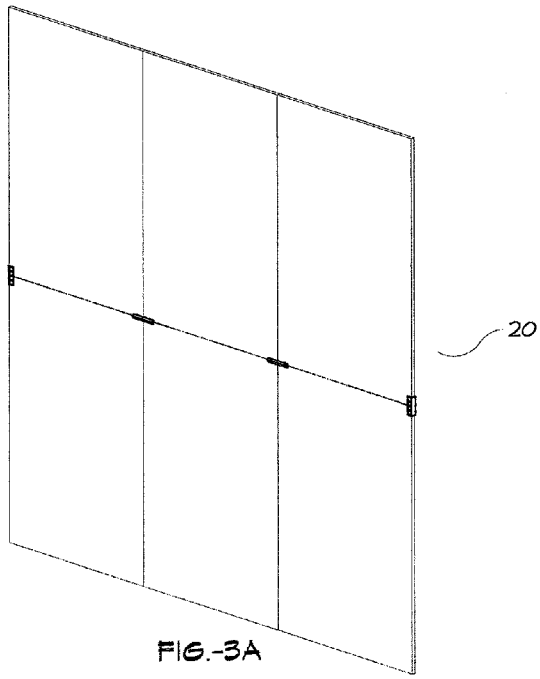

The present invention can be used in several ways, one of which is to join foam board 20 (FIG. 3A) onto the plane established by the above-described stretcher rails and rail support members. Foam board 20 can be collapsed as shown in FIG. 3B by providing living hinges 201. The foam board can also be separated into subparts 20*a* and 20*b* which can be joined onsite through the use of H-clip 202 (FIG. 3C). Foam board 20 can be further stabilized by providing clip member 203 as depicted in FIG. 3D. Collapsibility of foam board 20 further aids in the ease of transport and storage in accomplishing the goals of the present invention.

It is further noted that the present invention includes multiple substrate clips 15 moveable along rail support members 5. Substrate clips 15 include a planar portion and upturned lip and are extendible within openings 51 and 52 and other points within the present invention best depicted in FIG. 1 for receiving foam board of various sizes. Horizontally extending substrate clips 15 provide gravitational support for foam board 20 while vertically extending substrate clips act as stand-offs to keep the foam board aligned to the upper and lower rails.

It is noted that foam board 20 can be of several sizes to accommodate different sized quiltings. When the foam board is of relatively small size, substrate clips 15 can be inserted within dowel openings 52 to enable the foam board to be supported by rail members 5*a* and 5*b* as well as by substrate clip 15 emanating from butterfly wing 12*a* supported on device support member 66, the later to be discussed hereinafter. When foam board 20 is of a larger size, substrate clip 15 can be moved to dowel opening 51. Thus, a significant advantage in the present invention is to provide enhanced flexibility by enabling quilt fabrication and display device 1 to receive substrates, such as foam board 20 of various sizes and, in this event, reference is again made to FIGS. 1 and 2.

In the event that a larger quilt is to be constructed or displayed using the present invention, the kit of parts representing the present quilt fabrication and display device is intended to also include butterfly wing extenders 12 at each corner of said upper and lower stretcher rails, the wing extenders attaching selectively to stretcher ends 2 the upper butterfly wings extending diagonally upward of upper stretcher rail 16 while lower butterfly wings 2 extend diagonally downward from lower stretcher rail 17 to create a larger effective area for support of larger foam sheeting 20B as shown in FIG. 3B. Optional butterfly wing 12 can be appended to device support member 66 to centrally support foam board 20 as needed. To complete the structure, cable 13 can be configured within grooves at extremities 12*b* of butterfly wing extenders 12. Stand-offs 12*c* can also be optionally employed to stabilize cable 13. Once cable 13 has been applied to the four grooves of butterfly wing extenders 12, its ends can be closed by use of latch 14. In doing so, the effective peripheral surface of quilt fabrication and display device 1 has expanded from the extremities of stretcher ends 2 to the boundaries created by cable 13. Thus, in using a foam board of a larger size, it can be supported noting that substrate clips 15 are moved to a position lower on rail support members 5*a* and 5*b*.

It should also be appreciated that the present invention has been described in terms of a quilt fabrication and display device accepting a fabric work surface with or without optional foam board support 20. It is noted that the foam board could be eliminated as suitable quilt pieces are applied to the fabric work surface without any foam board backing.

Figure 5A:
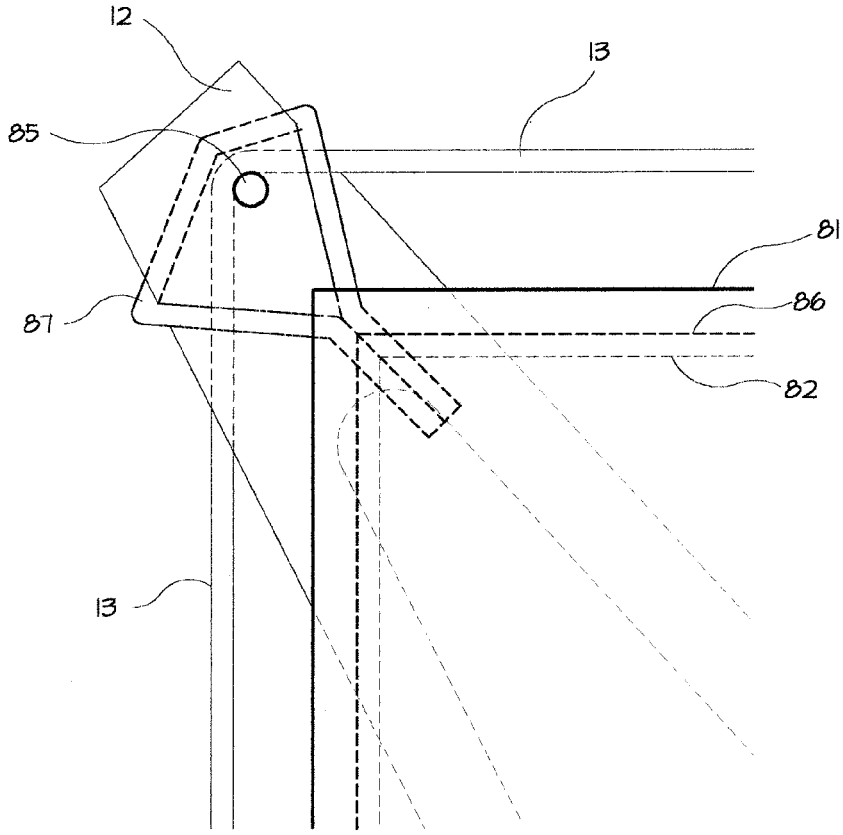
FIGS. 5A, 5B and 5C are partial plan views of the present invention illustrating an example of the attachment of a fabric working surface to the present invention.
Figure 5B:
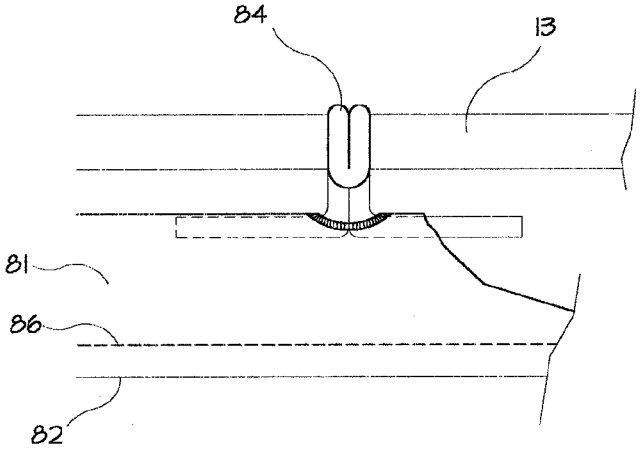
Figure 5C:
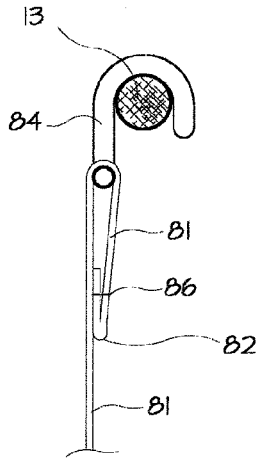

Turning to FIGS. 5A, 5B and 5C an example showing attachment of a suitable fabric work surface to the device of the present invention is depicted. Specifically, fabric 81 having a hem whose lower edge is shown as 82 is attached via hook 84 to cable 13. Cable 13 ideally travels within butterfly wing 12 over pins 85 used to minimize friction during feeding of cable 13 through butterfly wings 12 located at each corner of the device. The fabric 81 also includes loops 87 proximate each corner for attachment to butterfly wings 12. As noted, fabric 81 can be hemmed, the hems being created via stitching 86 as shown.

Although there are a number of ways in which fabric work surface 81 can be attached to the present invention, FIGS. 5A through 5C are representative of one such attachment protocol facilitating a rapid attachment-detachment scheme in keeping within the scope of the present invention.

Figure 4:
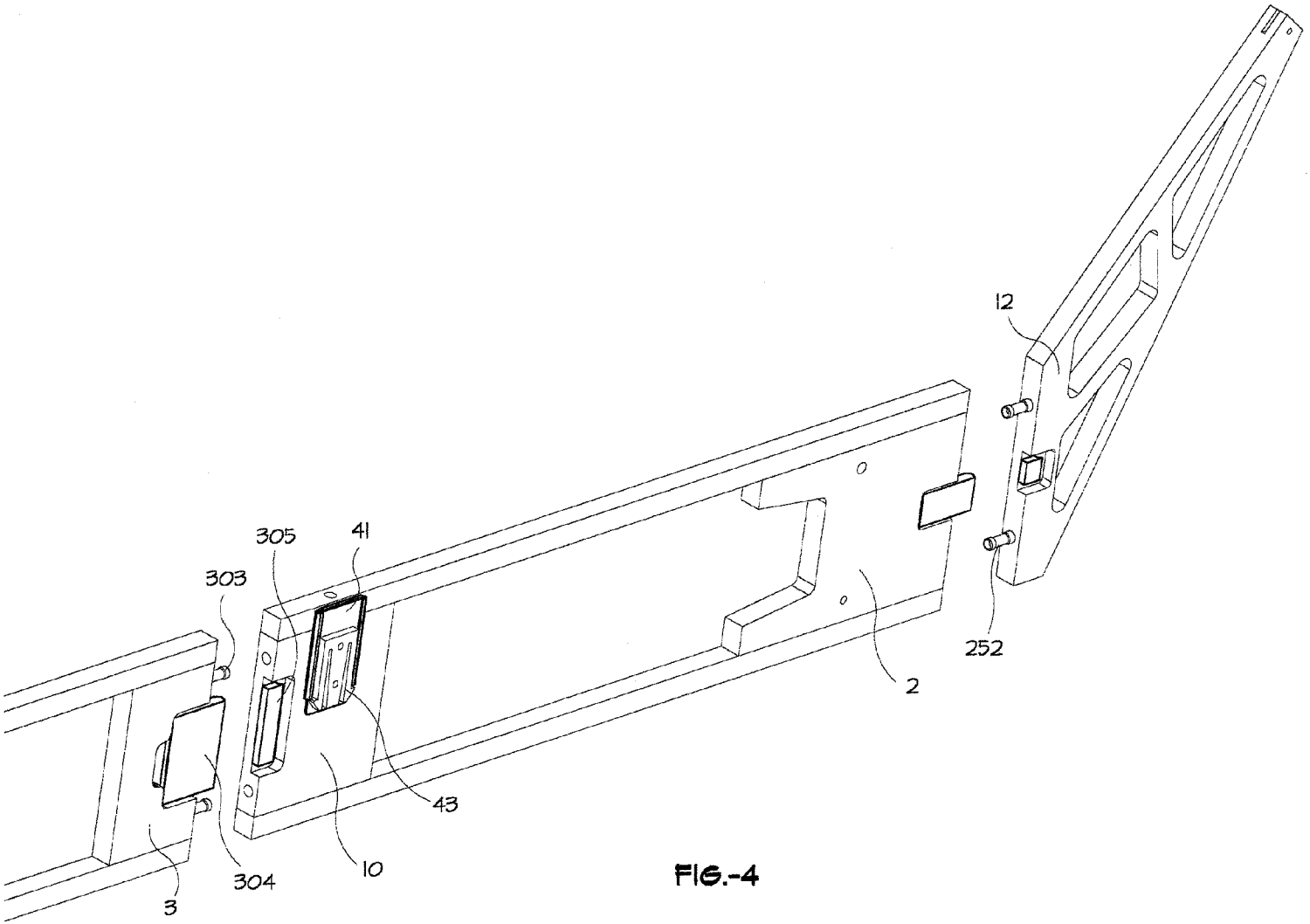
FIG. 4 is a perspective view of a latch and butterfly wing connector useful in practicing the present invention.

To this point, applicant has described the present invention as fundamentally a two dimensional structure which could be hung from a wall, leaned against a wall or otherwise employed. However, to make the present structure free standing, reference is made to FIGS. 2 and 4.

Figure 2:
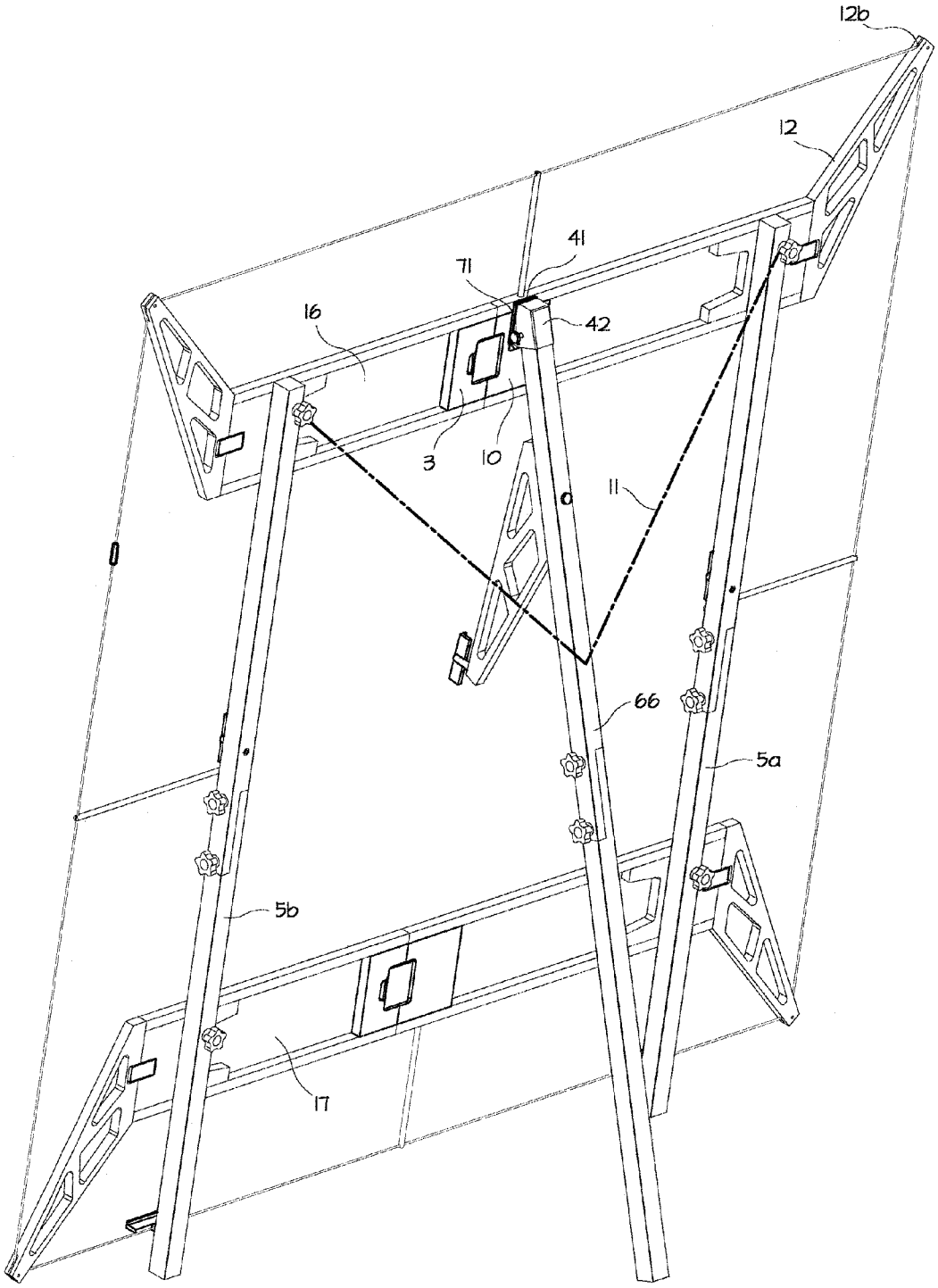
FIG. 2 is a rear perspective view of the present invention depicting its various parts constituting the invention as a whole.

In turning to the figures, a preferred embodiment of the present invention is disclosed in which support base 41 including living hinge 43 is depicted located behind and attached to substrate support 10. When the present quilt fabrication and display device is intended to be free standing, brace bracket 42 is slid onto living hinge 43 whereupon device support member 66 is caused to enter brace bracket 42 and held in place by thumb screw 71 (FIG. 2). In doing so, a tripod is established between device support member 66 and rail support members 5*a* and 5*b*. Alternatively, brace brackets could be located at stretcher ends 2 providing for two device support members 66 to establish a four point footprint. This would minimize the need for stabilizing cable 11.

As a preferred embodiment, optional stabilizing cable 11 can be employed. Stabilizing cable 11 is ideally strung between butterfly wings 12 and a point along device support member 66 as shown in FIG. 2.

Turning once again to FIG. 4, it is noted that, ideally, butterfly wings 12 are appended to stretcher ends 2 through the use of dowel pins 252. This makes for readily attachment and detachment of butterfly wings 12 as needed. Further, midconnect braces 3 can be selectively appended to substrate support 10 by using dowel pins 303, the connection being secured by a keeper noted as subparts 304 and 305.

In summary, it should be readily apparent that applicant has now taught a quilt fabrication and display device which can be configured as a kit of parts for easy storage and transport and which is flexible to the point of receiving and appropriately supporting a number of substrates of various sizes while remaining within the spirit and scope of the present invention. To date, no similar device has been suggested offering the type of flexibility and ease of use as that depicted herein.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A quilt fabrication and display device comprising upper and lower stretcher rails separated from one another by use of a pair of rail support members, said upper stretcher rails and lower stretcher rails being substantially parallel to one another and said rail support members being substantially parallel to one another and substantially orthogonal to said upper and lower stretcher rails, said upper and lower stretcher rails and said rail support members each comprising at least two subparts and fasteners for selectively connecting said subparts for assembly and disassembly of said quilt fabrication and display device, a set of four butterfly wing extenders, each butterfly wing extender selectively attachable to upper stretcher rails and lower stretcher rails such that when assembled, two of said butterfly wing extenders extend above said upper stretcher rails and two of said butterfly wing extenders extend below said lower stretcher rails, a substrate cable joining each of said butterfly wing extenders providing a cable perimeter having sections between said butterfly wing extenders parallel to said upper and lower stretcher rails and said rail support members.

2. The quilt fabrication and display device of claim 1 further comprising at least two substrate clips.

3. The quilt fabrication and display device of claim 2 wherein said at least two substrate clips are selectively positionable along said rail support members.

4. The quilt fabrication and display device of claim 1 wherein said upper and lower stretcher rails further comprise stretcher ends located at the ends of each of said upper and lower stretcher rails.

5. The quilt fabrication and display device of claim 4 wherein said butterfly wing extenders selectively attach to said stretcher ends.

6. The quilt fabrication and display device of claim 1 further comprising a brace bracket selectively attachable to the said upper stretcher rail and a device support member sized to be releasably secured by said brace bracket forming a tripod between said device support member and said rail support members.

7. The quilt fabrication and display device of claim 6 further comprising a stabilizer cable positioned between said butterfly wings extending from said upper stretcher rails and said device support.

8. A kit of parts for creating a quilt fabrication and display device, said kit of parts comprising upper and lower stretcher rails each of which is of two subparts and including fasteners for selectively connecting the subparts thereof, a pair of rail support members in the form of subparts and fasteners for selectively connecting said subparts to create said rail support members, a set of four butterfly wing extenders, each butterfly wing extender configured to be selectively attachable to upper stretcher rails and lower stretcher rails such that when assembled, two of said butterfly wing extenders extend above said upper stretcher rails and two of said butterfly wing extenders extend below said lower stretcher rails and a substrate cable of a length for joining each of said butterfly wing extenders when positioned upon ends of said upper and lower stretcher rails.

9. The kit of claim 8 further comprising at least two substrate clips.

10. The kit of claim 8 wherein said rail support members are configured with receiving slots for positioning said substrate clips thereupon.

11. The kit of claim 8 wherein said upper and lower stretcher rails further comprise stretcher ends located at the ends of each of said upper and lower stretcher rails.

12. The kit of claim 8 further comprising a brace bracket selectively attachable to said upper stretcher rail and a device support member sized to be releasably received by said brace bracket forming a tripod between said device support member and said rail support members upon configuring said kit of parts into said quilt fabrication and display device.

13. The kit of claim 12 further comprising a stabilizer cable sized to be positioned between said butterfly wings extending from said upper stretcher rails and said device support.

14. The kit of claim 8 further comprising a sheet of foam board.

15. The kit of claim 14 wherein said foam board is collapsible for shipment and storage in a first orientation and expandable in a second orientation, said second orientation being of a planar geometry for use with said quilt fabrication and display device.

16. The kit of claim 8 further comprising a fabric work surface.

17. The kit of claim 16 wherein a sheet of foam board is included as a support for said fabric working surface.

* * * * *